United States Patent [19]

Klusmier

[11] Patent Number: 4,545,724

[45] Date of Patent: Oct. 8, 1985

[54] APPARATUS FOR ASSEMBLING ELONGATED ELEMENTS

[75] Inventor: Kenneth L. Klusmier, Worcester, Mass.

[73] Assignee: Morgan Construction Company, Worcester, Mass.

[21] Appl. No.: 489,218

[22] Filed: Apr. 27, 1983

[51] Int. Cl.[4] ..... B65B 13/20

[52] U.S. Cl. ..... 414/745; 414/45; 414/100

[58] Field of Search ..... 414/900, 745, 746, 748, 414/100, 98, 91, 78, 63, 45; 100/2, 7

[56] References Cited

U.S. PATENT DOCUMENTS

| | | | |
|---|---|---|---|
| 4,174,662 | 11/1979 | Klusmier | 414/748 |
| 4,268,203 | 5/1981 | Huber et al. | 414/100 |

FOREIGN PATENT DOCUMENTS

| | | | |
|---|---|---|---|
| 1247950 | 8/1967 | Fed. Rep. of Germany | 414/745 |
| 0143043 | 7/1980 | German Democratic Rep. | 414/748 |
| 0531782 | 11/1976 | U.S.S.R. | 414/748 |

*Primary Examiner*—Joseph E. Valenza
*Assistant Examiner*—Lyle Kim
*Attorney, Agent, or Firm*—Maurice E. Gauthier

[57] ABSTRACT

An apparatus for assembling tubes, bars, rods and other like elongated elements preparatory to bundling the same.

7 Claims, 5 Drawing Figures

APPARATUS FOR ASSEMBLING ELONGATED ELEMENTS

BACKGROUND OF THE INVENTION

1. Field of the Invention

This invention relates generally to the field of material handling, and is concerned in particular with an apparatus for assembling tubes, bars, rods and other like elongated elements preparatory to bundling the same.

2. Description of the Prior Art

Numerous arrangements have been proposed for assembling elongated elements of the type referred to above. In some of these arrangements, for example those disclosed in U.S. Pat. Nos. 4,268,203 (Huber et al); 3,950,920 (Thomsen et al); and 3,871,288 (White), the elements are accumulated in assembly zones defined by the catenaries of flexible chains, slings or the like. The difficulty with such arrangements is that as the sizes of the catenaries are gradually increased during assembly, the elongated elements in contact with the chains or slings are rolled one against the other. This in turn can lead to twisting or "jackstrawing" of the elements, a condition which is detrimental to the final bundle.

Other known arrangements, for example those disclosed in U.S. Pat. Nos. 4,174,662 (Klusmier); 3,338,376 (Cross); and 2,592,642 (Bardet) deposit elements in assembly zones defined in part by stationary members and in part by elevator platforms which are lowered gradually during assembly. The primary drawback of such arrangements is that they require overly complex and costly mechanisms for depositing or layering the elongated elements in the assembly zones.

SUMMARY OF THE PRESENT INVENTION

A primary objective of the present invention is the provision of an improved apparatus having the capability of accumulating elongated elements without twisting or jackstrawing, and without resort to overly complicated and expensive components.

In a preferred embodiment of the invention to be described hereinafter in more detail, stationary members define one side of an assembly zone. First pivotal members are associated with the stationary members. When the first pivotal members are in their raised operative positions, they define the opposite side of the assembly zone, with the upper ends of both the stationary members and the first pivotal members being shaped to define a relatively narrow guide path leading downwardly to the assembly zone.

A conveyor laterally transports and drops elongated elements into the guide path for delivery under the influence of gravity into the accumulating zone. Second pivotal members, which extend transversally across the assembly zone, are gradually lowered during the assembly process to insure that the elongated elements dropping from the conveyor come to rest while still within the relatively narrow confines of the upper portion of the assembly zone or the guide path leading thereto. At the end of the assembly process, both the first and second pivotal members are lowered to inoperative positions in order to accommodate removal of the elements from the assembly zone.

Preferably, the upper ends of the first pivotal members extend vertically above the level at which elongated elements are dropped into the guide path by the conveyor, thereby controlling the tendency of the elements to "whip" if they are not parallel with the conveyor delivery end when they drop into the guide path.

Advantageously, the gradual lowering of the second pivotal members is controlled by means of photo-electric sensors arranged at vertically spaced levels along the guide path.

Preferably, the first and second pivotal members are arranged respectively on first and second parallel drive shafts located beneath and inwardly of the delivery end of the conveyor, with the first and second drive shafts being operated respectively by first and second piston-cylinder units.

These and other objects, features and advantages of the present invention will become more apparent in light of the following detailed description, taken in connection with the accompanying drawings, wherein:

DETAILED DESCRIPTION OF PREFERRED EMBODIMENT

Figure 1:
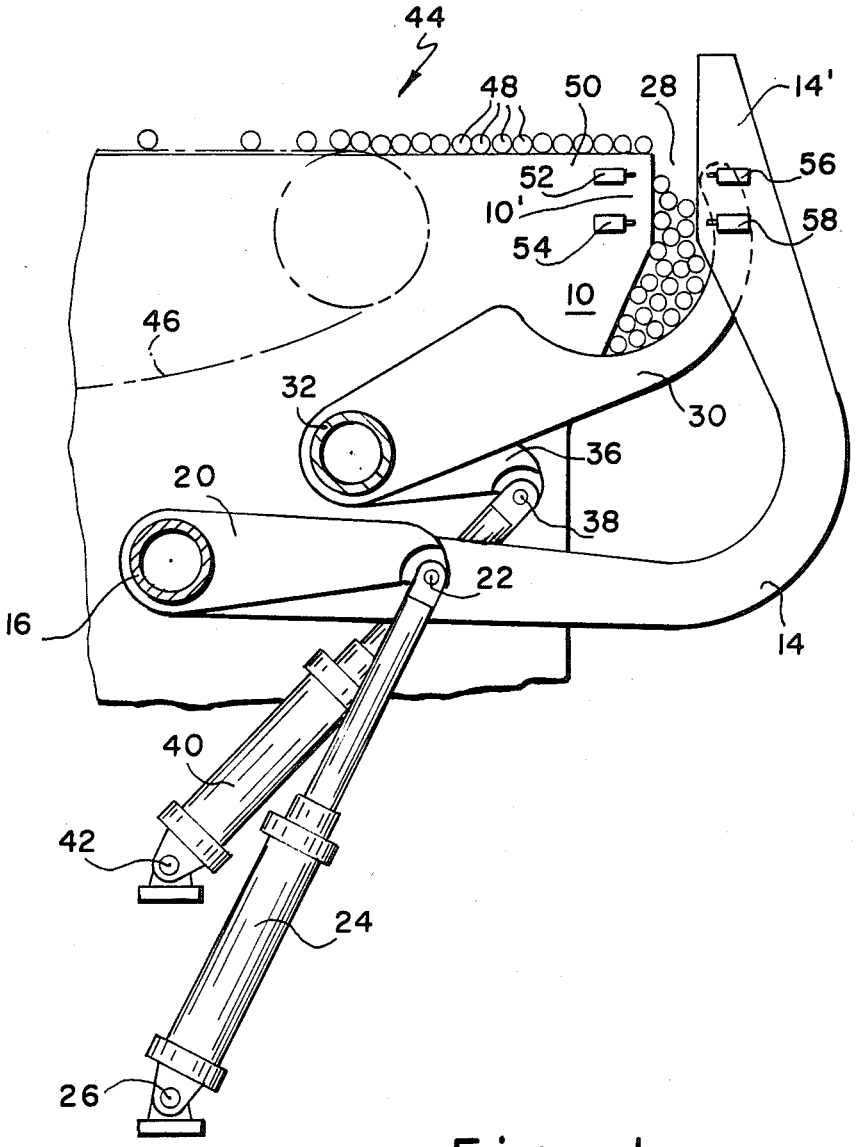
FIG. 1 is a view in side elevation of a preferred embodiment of an apparatus in accordance with the present invention, shown at an early stage in the assembly process.
Figure 2:
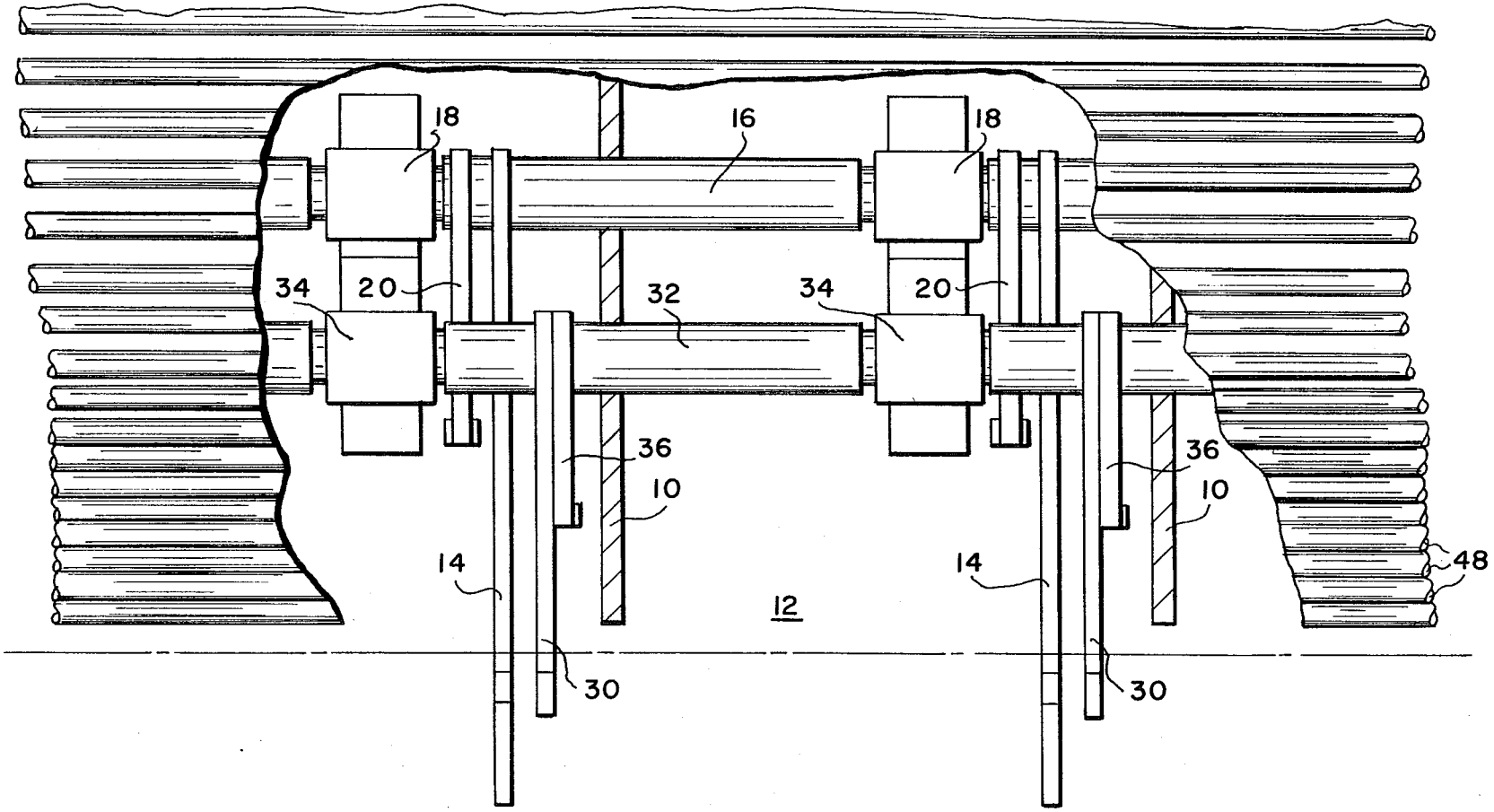
FIG. 2 is a partial plan view of the apparatus shown in FIG. 1 with portions of the conveyor broken away in order to better illustrate underlying components.

Referring initially to FIGS. 1 and 2, an assembly apparatus in accordance with the present invention is shown comprising stationary members 10 arranged to define one side of an assembly zone 12. First pivotal members 14 are associated with the stationary members. The first pivotal members are secured to a first drive shaft 16, the latter being journalled for rotation by means of appropriately spaced bearings 18. The first drive shaft 16 is additionally provided with crank arms 20 pivotally connected as at 22 to first piston-cylinder units 24, the latter being pivotally supported as at 26 to a foundation or supporting structure (not shown).

When in their raised operative positions as shown for example in FIG. 1, the first pivotal members 14 define the opposite side of the assembly zone 12. The upper ends 10' of the stationary members 10 as well as the upper ends 14' of the operatively positioned first pivotal member 14 are shaped to define a guide path 28 leading downwardly into the assembly zone 12. The width of the guide path is relatively narrow in comparison to that of the assembly zone.

Second pivotal members 30 are arranged to extend transversally across the assembly zone 12. The second pivotal members are secured to a second drive shaft 32 extending in parallel relationship to the first drive shaft 16. The second drive shaft also is journalled for rotation by means of appropriately spaced bearings 34, and is provided with one or more crank arms 36 pivotally connected as at 38 to second piston-cylinder units 40, the latter being pivotally supported as at 42.

A conveyor generally indicated at 44 has appropriately spaced chains (only one being shown in FIG. 1 at 46) which laterally transport elongated elements 48 towards a delivery end 50 defined for example by the upper substantially horizontal edges of the stationary members 10. The elongated elements may be bars, rods, tubes or shapes. While being transported on the chains 46, the elements 48 are normally laterally spaced one from the other. However, when the elements reach the delivery end of the conveyor, they are pushed against one another, causing the endmost elements to be dropped individually into the guide path 28 for ultimate delivery under the influence of gravity into the assembly zone 12.

At the outset of a given assembly cycle, both the first and second pivotal members 14 and 30 are in their raised operative positions as shown in FIG. 1. The second pivotal members 30 thus are located closely adjacent to the lower end of the guide path 28, where they cooperate with the inner edges of the stationary members in narrowly restricting the cross sectional area of the assembly zone 12 which is available to receive elongated elements.

Figure 4:
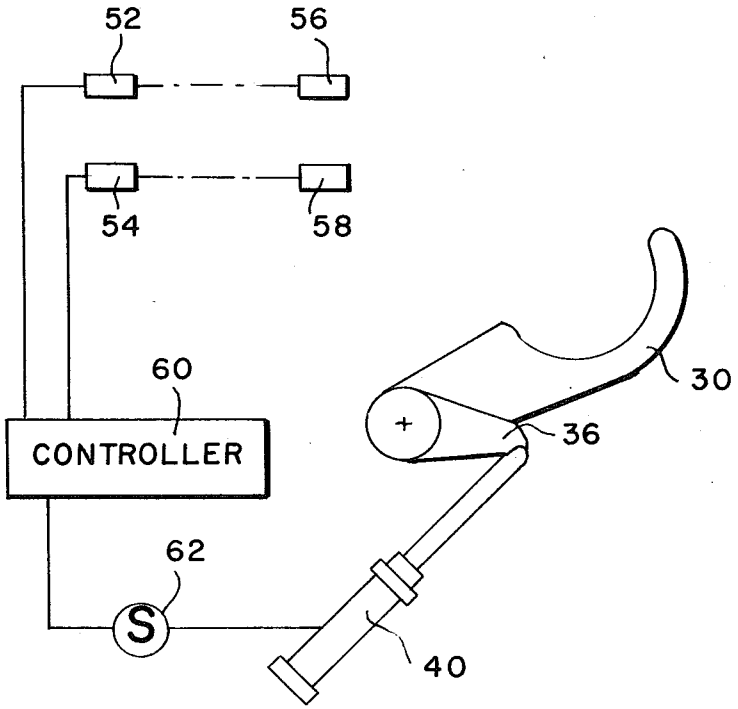
FIG. 4 is a schematic control circuit for the second pivotal members.

A pair of photoelectric sensors 52, 54 are mounted on one of the stationary members 10 at vertically spaced levels along the guide path 28. The sensors are each arranged to coact with light sources 56, 58 arranged on one of the first pivotal members 14. As shown in FIG. 4, the sensors 52, 54 generate control signals which are directed to a controller 60, the latter in turn being connected to a solenoid control valve 62 which controls the bleeding of hydraulic fluid from the second piston cylinder units 40.

Figure 3:
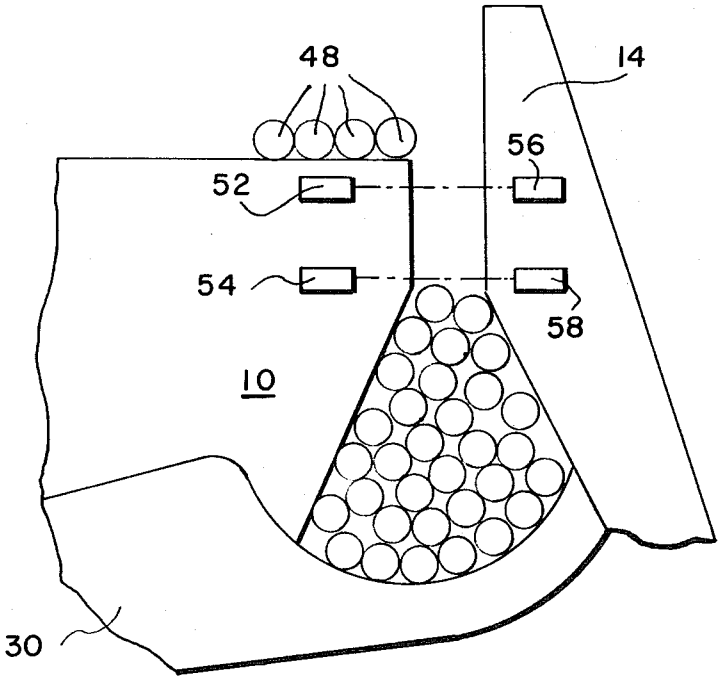
FIG. 3 is an enlarged side elevational view of the guide path and associated control components at a different stage in the assembly process.

Operation of the conveyor 44 will result in elongated elements 48 being pushed into the guide path 28 where they will drop into the assembly zone 12 onto the second pivotal members 30. As the elements accumulate in the assembly zone, they will eventually block the line of sight between sensor 52 and its light source 56. When this occurs, the sensor 52 will generate a control signal which will be processed by the controller 60, causing the latter to act through the solenoid valve 62 to bleed fluid from the second piston cylinder units 40. This in turn will cause the second pivotal members 30 to be lowered with an accompanying increase in the available space of the assembly zone 12. As this occurs, the level of the elements in the guide path will be lowered, and this will continue until the line of sight between sensor 54 and its light source 58 is reestablished. This will cause the sensor 54 to generate a control signal which will act through the controller 60 and solenoid valve 62 to interrupt further bleeding of hydraulic fluid from piston-cylinder unit 40, thus temporarily stopping the descent of the second pivotal members 30. This condition is shown in FIG. 3. Thereafter, elements will continue to accumulate in the narrow confines of the guide path 28 until the line of sight of sensor 52 is again interrupted, causing the second pivotal members to drop further away from the guide path. This step-by-step gradual lowering of the second pivotal members 30 will continue until a selected predetermined number of elements has been accumulated in the assembly zone 12, at which point in time the operation of conveyor 44 will be interrupted.

Preferably, the upper ends of the first pivotal members 14 are arranged to protrude above the level of the conveyor delivery end 50. With this arrangement, should the elements have a tendency to "whip" as they leave the conveyor delivery end, the upwardly protruding ends of the pivotal members 14 will confine the elements and control their descent into the guide path 28. It is also important to note that because of the operation of the sensors 52, 54 acting through controller 60 and valve 62, the majority of the elements will come to rest within the relatively narrow confines of the guide path 28. This markedly reduces any tendency of the elements to twist or jackstraw, thus improving the form of the resulting bundle.

Another advantage of the present invention stems from the fact that as the second pivotal members 30 are gradually lowered, there is relatively little accompanying rolling or shifting of the elements relative to one another in the assembly zone. This further minimizes any tendency of the elements to twist or jackstraw.

Figure 5:
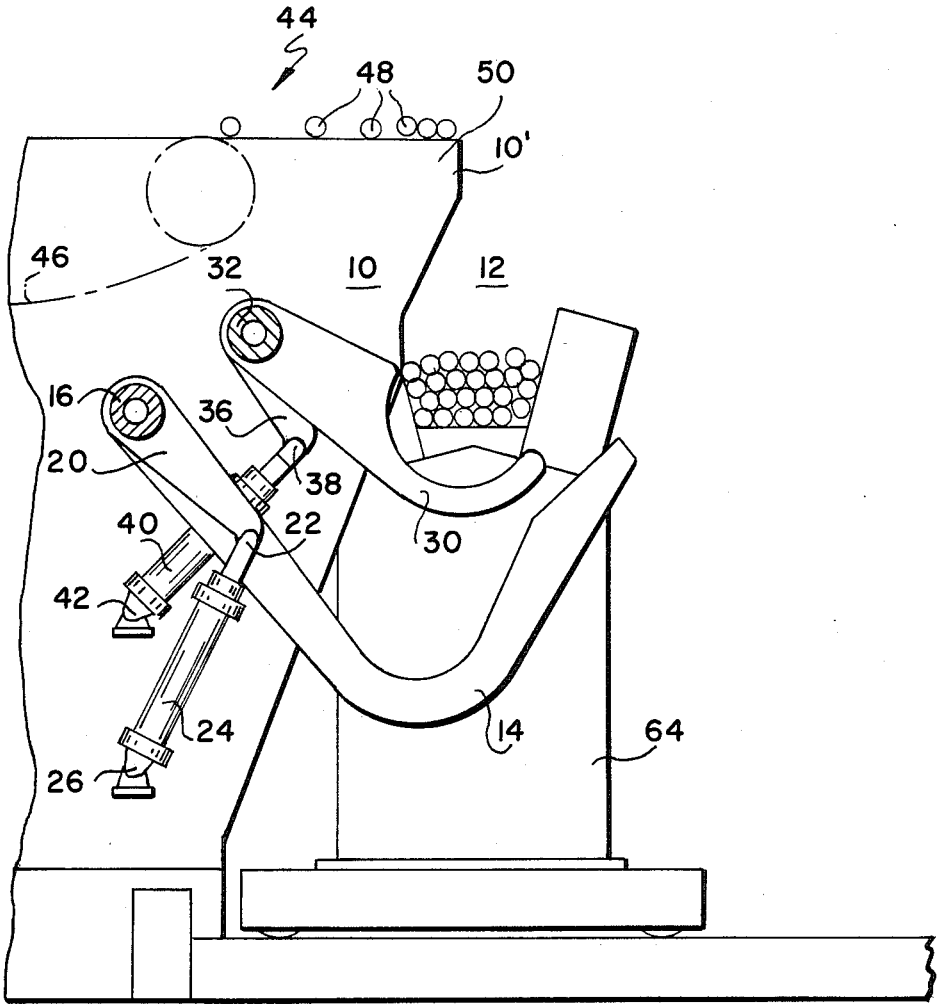
FIG. 5 is a view similar to FIG. 1 showing the apparatus at the end of the assembly process, with the pivotal members arranged to accommodate removal of the assembled elements from the assembly zone.

At the end of a given cycle, the first and second pivotal members 14, 30 are lowered to the inoperative positions shown in FIG. 5. An appropriately designed carrier 64 is arranged beneath the assembly zone to receive the accumulated elements for transfer to another location for further processing and/or binding.

In addition to the operational advantages mentioned above, the present invention also offers a compact relatively simple design. The first and second parallel drive shafts 16, 32 and their associated operating mechanism are located beneath and inwardly of the conveyor delivery end 50, with only the first and second pivotal members 14, 30 protruding beyond the conveyor. This space-saving design facilitates adaptation of the invention to a wide variety of applications. Manipulation of the pivotal members 14, 30 is accomplished by a relatively simple operating system including the first and second piston-cylinder units controlled by appropriately arranged photoelectric sensors, thus minimizing initial capital investment as well as subsequent maintenance costs.

I claim:

1. Apparatus for assembling tubes, bars, rods and other like elongated elements preparatory to bundling the same, said apparatus comprising:

stationary members arranged to define one side of an assembly zone;

first pivotal members associated with said stationary members, said first pivotal members, when in raised positions, being arranged to define the opposite side of said assembly zone, with the upper ends of both said stationary members and said raised first pivotal members being shaped to define a guide path therebetween leading downwardly to said assembly zone, the width of said guide path being relatively narrow in comparison to that of said assembly zone;

first operating means for pivotally adjusting said first pivotal members between their raised positions and lowered discharge positions accommodating the removal of accumulated elongated elements from said assembly zone;

conveyor means for laterally transporting and dropping elongated elements through said guide path into said assembly zone;

second pivotal members extending transversally across said assembly zone, said second pivotal members being arranged to support the elongated elements received from above through said guide path and to cooperate with said stationary members and said first pivotal members in containing the thus received elongated elements in said assembly zone;

second operating means for pivotally manipulating said second pivotal members between raised positions adjacent to the lower end of said path and lowered positions also accommodating the removal of accumulated elements from said zone; and control means associated with said second operating means for effecting a progressive lowering of said second pivotal members during accumulation of elongated elements in said assembly zone in order to control the distance through which said elements are permitted to drop from said conveyor means.

2. The apparatus of claim 1 wherein the upper ends of said first pivotal members extend vertically above the level at which elongated elements are dropped into said guide path by said conveyor means.

3. The apparatus of claim 1 wherein the progressive lowering of said second pivotal members by said control means acting through said second operating means is such that elongated elements dropping from said conveyor means are brought to rest within the relatively narrow confines of said guide path.

4. The apparatus of claim 1, 2 or 3 wherein said control means includes photoelectric sensors arranged at vertically spaced levels along said guide path.

5. The apparatus of claim 1 wherein first and second pivotal members are arranged respectively on parallel rotatable first and second drive shafts.

6. The apparatus of claim 5 wherein said first and second drive shafts are located beneath and inwardly of the delivery end of said conveyor means, and wherein said first and second pivotal members protrude outwardly beyond said delivery end.

7. The apparatus of claim 5 or 6 wherein said first and second operating means comprise first and second piston-cylinder units connected respectively to said first and second drive shafts.

* * * * *